US012484622B2

(12) United States Patent
Hu et al.

(10) Patent No.: US 12,484,622 B2
(45) Date of Patent: Dec. 2, 2025

(54) AEROSOL GENERATING DEVICE

(71) Applicant: SHENZHEN FIRST UNION TECHNOLOGY CO.,LTD., Shenzhen (CN)

(72) Inventors: Ruilong Hu, Shenzhen (CN); Wei Chen, Shenzhen (CN); Zhongli Xu, Shenzhen (CN); Yonghai Li, Shenzhen (CN)

(73) Assignee: SHENZHEN FIRST UNION TECHNOLOGY CO., LTD. (CN)

( * ) Notice: Subject to any disclaimer, the term of this patent is extended or adjusted under 35 U.S.C. 154(b) by 590 days.

(21) Appl. No.: 17/758,464

(22) PCT Filed: Jan. 8, 2021

(86) PCT No.: PCT/CN2021/070919
§ 371 (c)(1),
(2) Date: Jul. 7, 2022

(87) PCT Pub. No.: WO2021/139786
PCT Pub. Date: Jul. 15, 2021

(65) Prior Publication Data

US 2023/0337738 A1 Oct. 26, 2023

(30) Foreign Application Priority Data

Jan. 8, 2020 (CN) ..... 202010016109.X

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
None
See application file for complete search history.

(56) References Cited

U.S. PATENT DOCUMENTS 4,776,353 A * 10/1988 Lilja ..... A24B 15/18 131/273
11,044,941 B2 * 6/2021 Jeong ..... A24F 40/485
(Continued)

FOREIGN PATENT DOCUMENTS

CN 201700020 U 1/2011
CN 102665459 A * 9/2012 ..... A24B 15/16
(Continued)

OTHER PUBLICATIONS

English Translation of CN 205547365 (Year: 2016).*
English Translation of CN 102665459 (Year: 2012).*
English Translation of CN 108095203 (Year: 2018).*

*Primary Examiner* — Manley L Cummins, IV
(74) *Attorney, Agent, or Firm* — PROI Intellectual Property US

(57) ABSTRACT

An aerosol generating device, comprising a chamber (232); an infrared emitter (230) having a tubular base (231) and an infrared emitting coating (233) formed on the outer surface of the tubular base (231); a conductive element abutting against the infrared emitting coating (233) to perform conduction with the infrared emitting coating (233); a retaining mechanism configured to extend in an axial direction of the infrared emitter (230) and surround the infrared emitter (230), and used for supporting the infrared emitter (230) and the conductive element, wherein the conductive element is located between the retaining mechanism and the infrared emitter (230) in a radial direction of the infrared emitter (230), and abuts against the infrared emitting coating (233) under the support of the retaining mechanism; and a battery cell (14) electrically connected to the conductive element to supply power to the infrared emitting coating (233).

12 Claims, 6 Drawing Sheets

(56) References Cited

U.S. PATENT DOCUMENTS

| | | | | |
|---|---|---|---|---|
| 2013/0014772 | A1* | 1/2013 | Liu | A24F 40/30 131/329 |
| 2016/0021930 | A1* | 1/2016 | Minskoff | A24F 40/51 392/395 |
| 2016/0219938 | A1* | 8/2016 | Mamoun | G05B 15/02 |
| 2016/0255879 | A1* | 9/2016 | Paprocki | H05B 1/0291 |
| 2016/0360794 | A1* | 12/2016 | Li | H05B 3/46 |
| 2017/0035115 | A1* | 2/2017 | Monsees | H05B 3/44 |
| 2018/0140018 | A1 | 5/2018 | Hu et al. | |
| 2020/0046028 | A1* | 2/2020 | Oh | H05B 3/46 |
| 2022/0240581 | A1* | 8/2022 | Chen | A24F 40/46 |
| 2022/0322743 | A1* | 10/2022 | Xie | H05B 3/04 |

FOREIGN PATENT DOCUMENTS

| | | | | | |
|---|---|---|---|---|---|
| CN | 104397878 | A | | 3/2015 | |
| CN | 205547365 | U | * | 9/2016 | |
| CN | 205567812 | U | | 9/2016 | |
| CN | 106490686 | A | | 3/2017 | |
| CN | 108095203 | A | | 6/2018 | |
| CN | 108185537 | A | | 6/2018 | |
| CN | 109846093 | A | | 6/2019 | |
| CN | 212279891 | U | | 1/2021 | |
| EP | 3243395 | A2 | | 11/2017 | |
| EP | 3932227 | A1 | * | 1/2022 | A24F 40/20 |
| WO | 2008130813 | A1 | | 10/2008 | |

* cited by examiner

AEROSOL GENERATING DEVICE

CROSS REFERENCE TO RELATED APPLICATION(S)

This application claims priority to Chinese Patent Application No. 202010016109.X, entitled "Aerosol generating device" and submitted to China National Intellectual Property Administration on Jan. 8, 2020, the entire content of which is incorporated herein by reference.

TECHNICAL FIELD

The embodiment of the present disclosure relates to the technical field of heating nonburning smoking sets, and in particular to an aerosol generating device.

BACKGROUND

Tobacco products (e.g., cigarettes, cigars, etc.) are burning tobaccos to produce tobacco smoke during use. People attempt to make products that release compounds without burning so as to replace these tobacco products burning tobaccos.

An example of this kind of products is a heating device, which heats rather than burns a material to release compounds, for example, the material may be a tobacco product or other non-tobacco products which may contain or not contain nicotine. As another example, there exists an infrared heating device which heats a tobacco product through infrared radiation so that the tobacco product releases a compound to generate an aerosol. For example, the patent No. 201821350103.0 of a known technology provides a heating device structure in which a nano far infrared coating and a conductive coating are formed in turn on an outer surface of a quartz tube, wherein the conductive coating is connected to a power source configured to supply power, so that the nano far infrared coating itself generates heat under the supply of power and at the same time forms electron transition to generate infrared rays which then radiate onto the tobacco product within the quartz tube to heat the tobacco product.

During the implementation of the above device, the conductive coating is printed on the nano far infrared coating, there exists a problem of insufficient adhesion and bonding in the overlapping contact part between the conductive coating formed by printing and the nano far infrared coating, causing poor conduction or contact.

SUMMARY

In order to solve the problem about the printed conductive coating supplying power to the infrared coating in existing technologies, the embodiment of the present disclosure provides an aerosol generating device with stable connection.

In view of the above, the present disclosure provides an aerosol generating device, configured to heat a smokable material to generate an aerosol for inhalation, including a shell, wherein inside the shell are provided:

- a chamber, which is configured to receive a smokable material;
- an infrared emitter, which includes a tubular base extending in an axial direction of the chamber and surrounding the chamber, and an infrared emitting coating formed on an outer surface of the tubular base;

- a conductive element, which performs conduction with the infrared emitting coating;
- a retaining mechanism, which is configured to be arranged on outside of the infrared emitter, and is configured to provide support for the conductive element, wherein the conductive element is located between the retaining mechanism and the infrared emitter in a radial direction of the infrared emitter, and abuts against the infrared emitting coating under the support of the retaining mechanism; and
- a battery cell, which is electrically connected to the conductive element to supply power to the infrared emitting coating, so that the infrared emitting coating radiates infrared rays towards the smokable material received within the chamber, thereby heating the smokable material.

In a more preferred embodiment, the conductive element extends at least in part to outside of the retaining mechanism in an axial direction of the retaining mechanism and forms an electric connection part configured to conduct electric connection with the battery cell.

In a more preferred embodiment, the conductive element includes:

- a first part, which extends in an axial direction of the infrared emitter and abuts against the infrared emitting coating; and
- a second part, which is formed by extending from the first part in a circumferential direction of the infrared emitter; wherein
- at least part of the first part extends in the axial direction of the retaining mechanism to outside of the retaining mechanism to form the electric connection part.

In a more preferred embodiment, a length of the first part extending in the axial direction of the infrared emitter is greater than a length of the infrared emitting coating extending in the axial direction of the infrared emitter.

In a more preferred embodiment, the conductive element includes:

- a first part, which extends in a circumferential direction surrounding the infrared emitter and abuts against the infrared emitting coating; and
- a second part, which extends from the first part in the axial direction of the retaining mechanism and extends at least in part to outside of the retaining mechanism to form the electric connection part.

In a more preferred embodiment, an inner surface of the retaining mechanism defines an accommodation groove, into which the conductive element is at least in part accommodated and which hereby provides support for the conductive element.

In a more preferred embodiment, the retaining mechanism includes a first end and a second end that are opposite in a length direction;

- the first end is provided with a first support part extending inwards in a radial direction, and the first support part is configured to provide support for the infrared emitter at the first end;
- and/or, the second end is provided with a second support part extending inwards in a radial direction, and the second support part is configured to provide support for the infrared emitter at the second end.

In a more preferred embodiment, the retaining mechanism includes a first retaining element and a second retaining element that are arranged in turn in a circumferential direction surrounding the infrared emitter, and a retaining space formed between the first retaining element and the second retaining element; and the infrared emitter and the conductive element are retained within the retaining space.

In a more preferred embodiment, the first retaining element is provided with a first connection structure extending in a circumferential direction;

the second retaining element is provided with a second connection structure extending in a circumferential direction;

the first retaining element and the second retaining element are connected through the cooperation between the first connection structure and the second connection structure.

In a more preferred embodiment, cross sections of both the first retaining element and the second retaining element are in the shape of a semicircular ring.

In a more preferred embodiment, outer surfaces of the first retaining element and the second retaining element are flatly jointed.

According to the above aerosol generating device, the conductive element as an electrode is supported by means of the retaining mechanism, so that the conductive element is attached to the infrared emitting coating to implement power supply, a preparation process of a printed electrode coating can be reduced, and an adhesion defect due to coating printing is eliminated; in addition, since there is no need to reserve a space on the infrared emitter for printing electrodes and welding leads, the entire surface of the infrared emitter may be completely formed with the infrared coating, improving the effective area of the infrared emitting coating.

BRIEF DESCRIPTION OF THE DRAWINGS

One or more embodiments are illustrated through the image(s) in corresponding drawing(s). These illustrations do not form restrictions to the embodiments. Elements in the drawings with a same reference number are expressed as similar elements, and the images in the drawings do not form proportional restrictions unless otherwise stated.

DETAILED DESCRIPTION

The present disclosure will become better understood from a detailed description of the present disclosure below taken in conjunction with drawings and particular embodiments.

An embodiment of the present disclosure provides an aerosol generating device which heats rather than burns a smokable material such as a cigarette, so that at least one ingredient of the smokable material is volatilized or released to form an aerosol for inhalation.

In a preferred embodiment, the aerosol generating device heats the smokable material by radiating far infrared rays having a heating effect; for example, far infrared rays of 3 μm to 15 μm, during operation, when the wavelength of the infrared rays matches with the wavelength absorbable by the volatile ingredient of the smokable material, the energy of the infrared rays is easy to be absorbed by the smokable material, thus the smokable material is heated so that at least one volatile ingredient is volatilized to generate an aerosol for inhalation.

Figure 1:
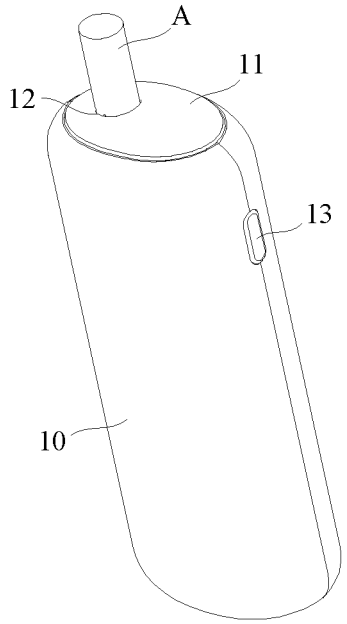
FIG. 1 is a schematic diagram of an aerosol generating device according to one embodiment.
Figure 2:
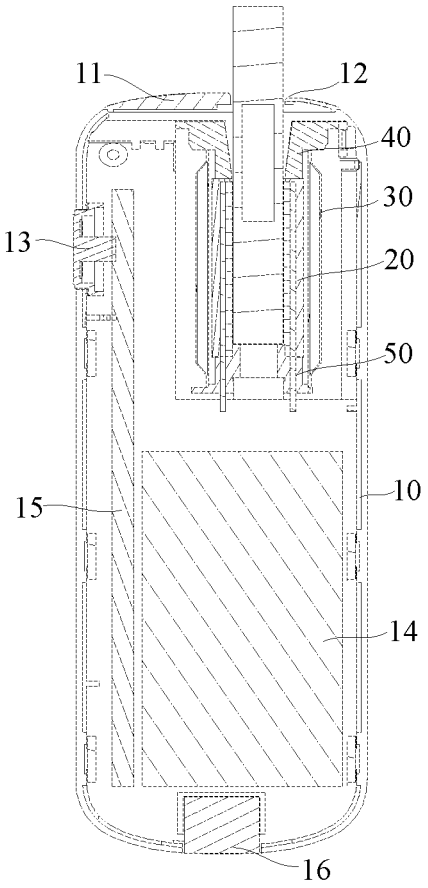
FIG. 2 is a cross-sectional view of the aerosol generating device shown in FIG. 1.

The aerosol generating device according to one embodiment of the present disclosure can refer to FIG. 1 to FIG. 2 in structure, the overall shape of the device is roughly configured as a tabular tube, and external components of the aerosol generating device include:

a shell 10, which is configured to be hollow inside, thereby forming an assembly space available for necessary functional components such as infrared radiation; and an upper cover 11 located on an upper end part of the shell 10 in a length direction; the upper cover 11 on one hand may cover the upper end of the shell 10 so that the aerosol generating device has a complete and beautiful appearance, on the other hand the upper cover may be detached from the upper end part of the shell 10 so that each functional component can be installed, detached, and replaced within the shell 10.

Further, from FIG. 1 and FIG. 2, the upper cove 11 includes an opening 12, through which the smokable material A may be received, in the length direction of the shell 10, at least in part within the shell 10 to be heated, or through which the smokable material A may be removed from inside of the shell 10.

The shell 10 is further provided with a switch button 13 on one side in a width direction, a user may manually actuate the switch button 13 to control the start or stop of the aerosol generating device.

Further, referring to FIG. 2, inside the shell 10 are provided:

a battery cell 14 configured to supply power;

a control circuit board 15 integrated with a circuit, configured to control the operation of the aerosol generating device;

a charging interface 16 configured to charge the battery cell 14, for example, a USB type-C interface, a Pin type interface, etc., which may charge the battery cell 14 after being connected to an external power source or adapter.

Further, referring to FIG. 2, in order to heat the smokable material A, a heating mechanism 20 is provided within the shell 10; in the preferred embodiment shown in FIG. 2, a heat insulating element 30, which is arranged on outside of the heating mechanism 20 in a radial direction, is further provided within the shell 10, to prevent the heat being transferred outward from the heating mechanism 20 to a surface of the shell 10. In a more preferred embodiment, the heat insulating element 30 is a vacuum heat insulating tube having an internal vacuum area, and the like.

Further, as shown in FIG. 2, the heating mechanism further includes an upper support element 40 and a lower support element 50, both of which are in the shape of a hollow ring and which provide support for two ends of the heating mechanism 20 and the heat insulating element 30 respectively, so that the heating mechanism 20 and the heat insulating element 30 are stably retained within the shell 10.

Figure 3:
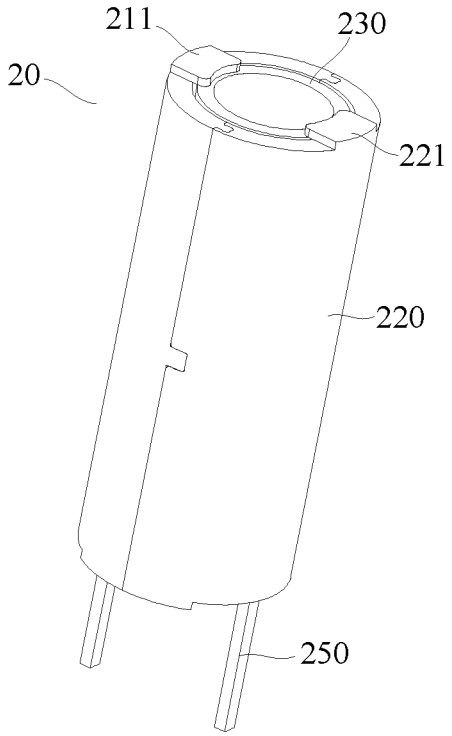
FIG. 3 shows, at an angle, the heating mechanism in FIG. 2.
Figure 4:
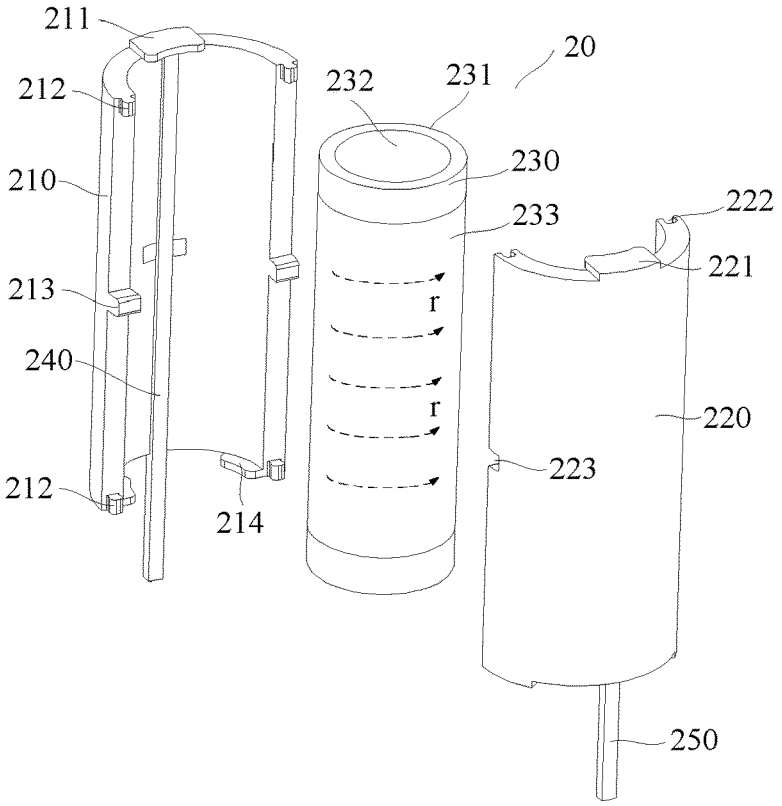
FIG. 4 is an exploded diagram of the heating mechanism shown in FIG. 3.

Further, referring to FIG. 3 and FIG. 4, the components that the overall structure and the exploded state of the heating mechanism 20 contain are shown, mainly including an infrared emitter 230, the infrared emitter 230 is an electro-infrared emitter which can radiate infrared rays towards the smokable material A when supplied with power; specifically, the infrared emitter 230 includes:

- a tubular base 231, of which an inner space forms a chamber 232 configured to receive and heat a smokable material A; the tubular base 231 as a rigid carrier and an article to receive and accommodate the smokable material A may be made of high-temperature resistant and infrared transmissive materials such as quartz glass, ceramic or mica, etc. during implementations, preferably made of transparent materials, for example, a high-temperature resistant material with infrared transmissivity over 95% is employed;
- an infrared emitting coating 233 formed on an outer surface of the tubular base 231; the infrared emitting coating 233 is capable of generating heat when electrified, thereby radiating infrared rays that can be used to heat the smokable material A, for example, the above far infrared rays of 3 μm to 15 μm. When the wavelength of the infrared rays matches with the wavelength absorbable by the volatile ingredient of the smokable material, the energy of the infrared rays is easy to be absorbed by the smokable material. Generally, during implementations, the infrared emitting coating 233 may be a coating made of ceramic materials such as zirconium, or Fe—Mn—Cu series, tungsten series, or transition metals and their oxide materials.

In a preferred embodiment, the infrared emitting coating 233 preferably is composed of an oxide of at least one metallic element among Mg, Al, Ti, Zr, Mn, Fe, Co, Ni, Cu, Cr, Zn, etc.; these metallic oxides when heated to an appropriate temperature can radiate far infrared rays having a heating effect; the thickness of the coating preferably may be controlled between 30 μm to 50 μm; the formation mode on the surface of the tubular base 231 may be achieved by spraying the oxides of the above metallic elements on the outer surface of the tubular base 231 through an atmospheric plasma spraying method and then curing it.

Further, referring to FIG. 3 to FIG. 4, the heating mechanism 20 includes a retaining mechanism arranged on outside of the infrared emitter 230 in a radial direction, so that on one hand the infrared emitter 230 may be stably retained within the shell 10 and on the other hand a conductive device may stably abut against or contact the surface of the infrared emitter 230 through the retaining mechanism; further, the conductive device may be connected to the battery cell 14, thereby supplying power to the infrared emitting coating 233 of the infrared emitter 230.

Specifically, the retaining mechanism includes a first retaining element 210 and a second retaining element 220 that are arranged in turn in a circumferential direction surrounding the infrared emitter 230; according to the preferred embodiment shown in FIG. 4, the first retaining element 210 and the second retaining element 220 are in the shape of a semicircular tube, which after being cooperated and assembled can compose a complete circular tubular fixed structure surrounding the infrared emitter 230.

Meanwhile, to facilitate the cooperation and assembly between the first retaining element 210 and the second retaining element 220, the first retaining element 210 is provided with a first clamping protrusion 212 that is located at two ends of the length direction and a second clamping protrusion 213 that is located on the middle part; correspondingly, the second retaining element 220 defines a first clamping groove 222 adapted to the first clamping protrusion 212 and a second clamping groove 223 adapted to the second clamping protrusion 213; during the assembly process, the first clamping protrusion 212 is embedded into the first clamping protrusion 212, and the second clamping protrusion 213 is embedded into the second clamping groove 223, so that the first retaining element 210 is connected and fixed with the second retaining element 220.

Further, two ends of the first retaining element 210 in the length direction are provided respectively with a first support part 211 and a second support part 214 that are extending inwards in a radial direction; similarly, two ends of the second retaining element 210 are further provided with a third support part 221 and a fourth support part (not shown in figures due to the angle of view) that are extending inwards in a radial direction; the above support parts are arranged for the purpose of providing support for two ends of the infrared emitter 230 accommodated within the first retaining element 210 and the second retaining element 220, thereby preventing the infrared emitter 230 moving in the axial direction and thus retaining and securing the infrared emitter 230.

Figure 5:
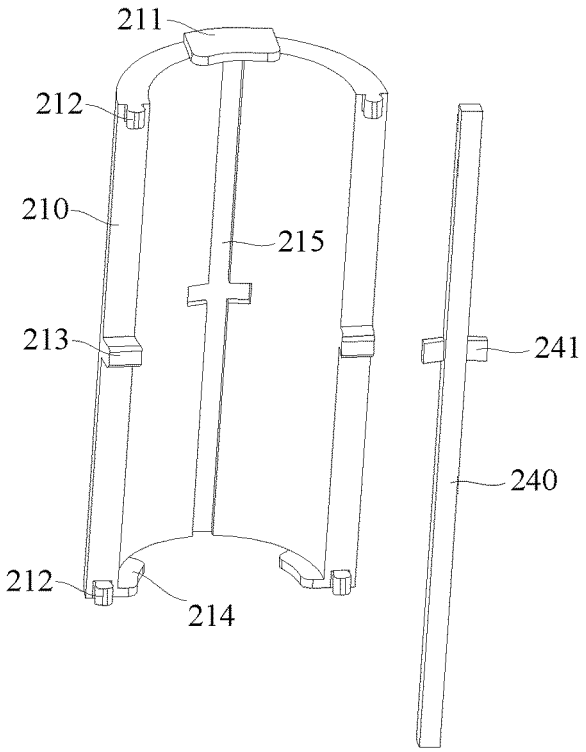
FIG. 5 is an exploded diagram of the first retaining element and the first conductive element shown in FIG. 4.
Figure 6:
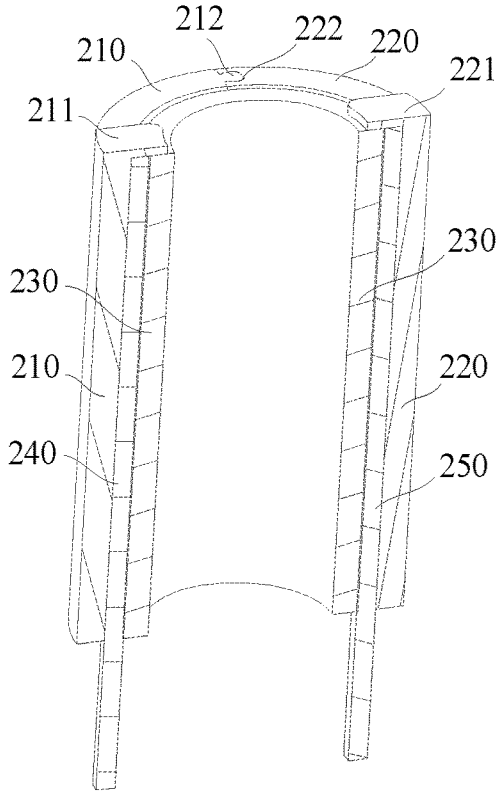
FIG. 6 is a three-dimensional cross-sectional view of the heating mechanism shown in FIG. 3.

Further, referring to FIG. 4 to FIG. 6, an inner wall of the first retaining element 210 is provided with a first conductive element 240; specifically, a main body of the first conductive element 240 is in the shape of a strip or sheet that extends in the length direction of the first retaining element 210, and the first conductive element 240, after being installed, extends at least in part to outside of a lower end of the first retaining element 210; similarly, an inner wall of the second retaining element 220 is also provided with a second conductive element 250. After being installed, the first conductive element 240 and the second conductive element 250 are attached to and perform conduction with the infrared emitting coating 233 on the outer surface of the infrared emitter 230, so that subsequently positive and negative electrodes of the battery cell 14 may be connected to the first conductive element 240 and the second conductive element to supply power to the infrared emitting coating 233, thereby providing the infrared emitting coating 233 with a current in the circumferential direction, as indicated by the arrow r shown in FIG. 6 and FIG. 4.

In a preferred embodiment, extension lengths of the first conductive element 240 and the second conductive element 250 in the axial direction of the infrared emitter 230 are greater than the extension length of the infrared emitting coating 233, so that the circumferential current of the infrared emitting coating 233 is continuous and complete. In a preferred embodiment, to enable the first conductive element 240 to be stably retained on the inner wall of the first retaining element 210, the inner wall of the first retaining element 210 defines a groove 215 configured to fix the first conductive element 240. Specifically, the first conductive element 240 further includes an extension part 241 extended out from the main body along two sides thereof, such that the first conductive element 240 after being accommodated or retained within the groove 215 is prevented from an axial movement.

Further, in a more preferred embodiment, flexible materials capable of providing an elastic force, such as silicone rubber, polyimide, sponge, etc., may be formed within the groove 215 by means of gluing, filling or spraying, etc., so that the first conductive element 240, when accommodated within the groove 215, can stably contact or be attached to the surface of the infrared emitting coating 233 under the action of the flexible force.

Similar to the above first conductive element 240, the second conductive element 250 has the same shape, structure, fixing and installation method, and the technical personnel can understand and perform implementation with reference to the first conductive element 240.

On the basis of the above first conductive element 240 and second conductive element 250 being used as electrodes to supply power to the infrared emitting coating 233, the first conductive element 240 and the second conductive element 250 may be made of materials with good conductivity and low resistivity, such as gold, silver, copper, etc.

Figure 7:
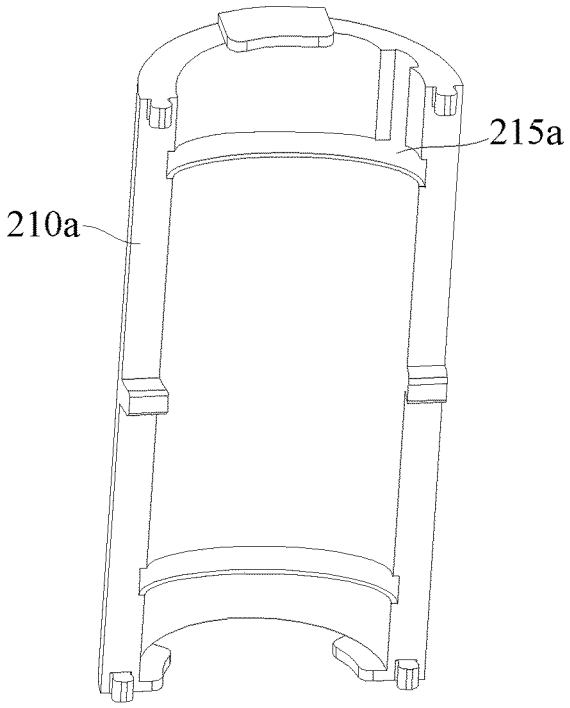
FIG. 7 is a schematic diagram of the first retaining element according to another embodiment.
Figure 8:
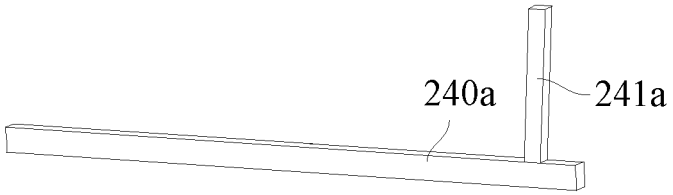
FIG. 8 is a schematic diagram of the first conductive element according to another embodiment.
Figure 9:
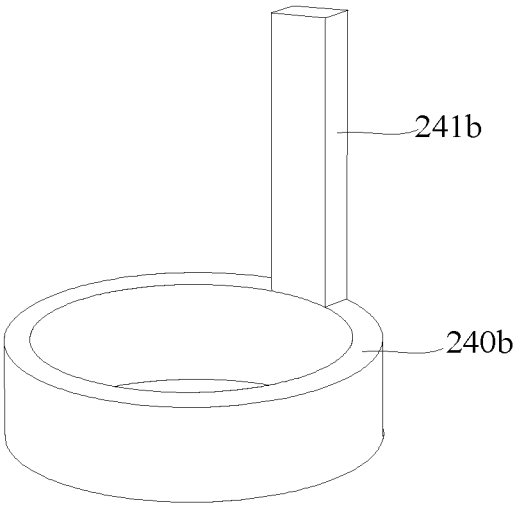
FIG. 9 is a schematic diagram of the first conductive element according to yet another embodiment.

In another variant embodiment, referring to FIG. 7 and FIG. 8, the inner wall of the first retaining element 210*a* defines a groove 215*a* close to upper and lower ends, a main body of the groove 215 extends in the circumferential direction, and correspondingly the first conductive element 240*a* shown in FIG. 8 is placed into the groove 215*a* in the circumferential direction. The above first conductive element 240*a* after being installed is attached to the outer surface of the infrared emitter 230 in the circumferential direction to form conduction. Note that the first conductive element 240*a* shown in FIG. 8 is in the shape of a straight strip; during implementation, due to the bendability and ductility of metal materials, the first conductive element may be conveniently installed into the groove 215*a* and attached to the outer surface of the infrared emitter 230 in the circumferential direction; alternatively, during other convenient implementations, the first conductive element 240*a* may be directly prepared into a ring shape, for example, the first conductive element 240*b* shown in FIG. 9.

Similarly, the second conductive element 20, which is provided corresponding to the first conductive element 240*a*, is attached to the outer surface of the infrared emitter 230 in the circumferential direction on the other end; the first and second conductive elements serve as positive and negative electrodes respectively to supply power to the infrared emitter 230, forming a current in the axial direction rather than the radial direction indicated by the arrow r shown in FIG. 4.

Further, the first conductive element 240*a* further includes an extension part 241*a* extended out from the main body, which on one hand prevents the first conductive element 240*a* moving in the circumferential direction within the groove 215*a* and which after being installed can extend to outside of the first retaining element 210*a* to be subsequently connected to positive and negative electrodes of the battery cell 14.

It is to be noted that the description of the present disclosure and the drawings just list preferred embodiments of the present disclosure and are not limited to the embodiments described herein. Further, for the ordinary staff in this field, improvements or variations may be made according to the above description, and all these improvements or variations are intended to be included within the scope of protection of the claims appended hereinafter.

What is claimed is:

1. An aerosol generating device, configured to heat a smokable material to generate an aerosol for inhalation, comprising a shell, wherein inside the shell are provided:

a chamber, which is configured to receive the smokable material;

an infrared emitter, which comprises a tubular base extending in an axial direction of the chamber and surrounding the chamber, and an infrared emitting coating formed on an outer surface of the tubular base;

a conductive element, which performs conduction with the infrared emitting coating;

a retaining mechanism, which is configured to be arranged on outside of the infrared emitter, and is configured to provide support for the conductive element, wherein the conductive element is located between the retaining mechanism and the infrared emitter in a radial direction of the infrared emitter, and abuts against the infrared emitting coating under the support of the retaining mechanism, wherein the retaining mechanism comprises a first retaining element and a second retaining element that are arranged in parallel in a circumferential direction, forming a hollow retaining space, wherein the first and second retaining elements enclose the infrared emitter, and wherein the infrared emitter and the conductive element are retained within the retaining space; and a battery cell, which is electrically connected to the conductive element to supply power to the infrared emitting coating, so that the infrared emitting coating radiates infrared rays towards the smokable material received within the chamber, thereby heating the smokable material.

2. The aerosol generating device according to claim 1, wherein the conductive element extends at least in part to outside of the retaining mechanism in an axial direction of the retaining mechanism and forms an electric connection part configured to conduct electric connection with the battery cell.

3. The aerosol generating device according to claim 2, wherein the conductive element comprises:

a first part, which extends in an axial direction of the infrared emitter and abuts against the infrared emitting coating; and a second part, which is formed by extending from the first part in a circumferential direction of the infrared emitter; wherein at least part of the first part extends in the axial direction of the retaining mechanism to outside of the retaining mechanism to form the electric connection part.

4. The aerosol generating device according to claim 3, wherein a length of the first part extending in the axial direction of the infrared emitter is greater than a length of the infrared emitting coating extending in the axial direction of the infrared emitter.

5. The aerosol generating device according to claim 2, wherein the conductive element comprises:

a first part, which extends in a circumferential direction surrounding the infrared emitter and abuts against the infrared emitting coating; and a second part, which extends from the first part in the axial direction of the retaining mechanism and extends at least in part to outside of the retaining mechanism to form the electric connection part.

6. The aerosol generating device according to claim 5, wherein the first part is in the shape of a ring surrounding the infrared emitter;

or, the first part is in the shape of a strip that is wrapped around a surface of the infrared emitter in the circumferential direction of the infrared emitter.

7. The aerosol generating device according to claim 1, wherein an inner surface of the retaining mechanism defines an accommodation groove, into which the conductive element is at least in part accommodated and which thereby provides support for the conductive element.

8. The aerosol generating device according to claim 1, wherein the retaining mechanism comprises a first end and a second end that are opposite in a length direction;

the first end is provided with a first support part extending inwards in a radial direction, and the first support part is configured to provide support for the infrared emitter at the first end;

and/or, the second end is provided with a second support part extending inwards in a radial direction, and the second support part is configured to provide support for the infrared emitter at the second end.

9. The aerosol generating device according to claim 1, wherein the first retaining element is provided with a first connection structure extending in a circumferential direction;

the second retaining element is provided with a second connection structure extending in a circumferential direction; and the first retaining element and the second retaining element are connected through the cooperation between the first connection structure and the second connection structure.

10. The aerosol generating device according to claim 1, wherein cross sections of both the first retaining element and the second retaining element are in the shape of a semicircular ring.

11. The aerosol generating device according to claim 1, wherein outer surfaces of the first retaining element and the second retaining element are flatly jointed.

12. The aerosol generating device according to claim 1, wherein the infrared emitter comprises a length in an axial direction of the chamber, and the conductive element traversing the length of the infrared emitter in the axial direction of the chamber, wherein the conductive element abuts against the infrared emitting coating along the length of the infrared emitter under the support of the retaining mechanism.

* * * * *